US007571691B2

(12) United States Patent
Russikoff

(10) Patent No.: US 7,571,691 B2
(45) Date of Patent: Aug. 11, 2009

(54) RETRACTABLE BIMINI TOP DEVICE

(76) Inventor: Ronald K. Russikoff, 3000 Glenview St., Philadelphia, PA (US) 19149

( * ) Notice: Subject to any disclaimer, the term of this patent is extended or adjusted under 35 U.S.C. 154(b) by 86 days.

(21) Appl. No.: 11/487,287

(22) Filed: Jul. 15, 2006

(65) Prior Publication Data

US 2008/0011217 A1 Jan. 17, 2008

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 4,848,827 A * 7/1989 Ou ..... 296/99.1
6,439,150 B1 * 8/2002 Murphy et al. ..... 114/361
2005/0252429 A1 * 11/2005 Logan et al. ..... 108/147

* cited by examiner

*Primary Examiner*—Stephen Avila
(74) *Attorney, Agent, or Firm*—Armand M. Vozzo, Jr.

(57) ABSTRACT

A retractable bimini top device is disclosed for automated operation and mounted attachment to an existing rooftop member set over the deck of a boat. The inventive device includes a U-shaped support frame having respective side legs adapted to travel longitudinally through a pair of housing tube members disposed in parallel and mounted beneath the rooftop member. The side legs of the U-shaped frame are coaxially fitted within the housing tube members and made to travel together in unison through the respective tube members, each upon a lead screw that is driven by a reversible motor electrically powered and mounted at the end of each tube. A canvas cover attached along its outer end to the transverse portion of the U-shaped frame is stored in a rolled-up state about a spring-loaded roller mounted transversely between the housing tube members so that the canvas cover may be extended in a substantially horizontal manner and retracted as the side legs of the support frame are moved in alternate linear directions through the housing tube members.

7 Claims, 9 Drawing Sheets

RETRACTABLE BIMINI TOP DEVICE

BACKGROUND OF THE INVENTION

The present invention relates to convertible top covers for boats, commonly called bimini tops, and more particularly to an improved retractable bimini top device assembled for operative attachment to existing rooftop structure on the main deck of the boat and automated in operation between a retracted storage position and a fully extended state.

In recreational boating, the so-called "bimini top" is a convertible cover erected upon the deck of the boat and made to be deployed at an elevation comfortably above the heads of the passengers. Drawing its name from the Bimini islands in the Bahamas where it was first employed by boaters to provide desired shade from the strong rays of the tropical sun, the standard type of bimini top and those convertible boat covers of the same nature generally comprise a flexible canvas material secured to a foldable support frame that is erected across the deck and pivotally attached thereto. These standard types of foldable bimini tops can be raised when needed or lowered into a substantially flat position upon the deck when not in use or when an overhead obstruction may otherwise require its lowering. Deployment of these foldable bimini tops is often done manually but has been designed to be power driven, such as those described in U.S. Pat. No. 6,209,477 to Briedenweg and U.S Pat. No 6,983,716 to Ankney et al. Regardless of their specific foldable structure or method of operational deployment, the installation and utilization of bimini tops have become increasingly important for the protection of passengers and crew on board boats against excessive sun exposure and the evident risks of skin cancer caused thereby.

Existing framework generally used to construct present bimini top installations includes a system of poles or like rigid members mounted to the port and starboard sides of the boat and made to extend across the deck at a sufficient height level to support the canvas top overhead the occupants. As currently arranged and implemented, these pole systems typically have separate front and rear pole members over which the canvas top is extended and, depending upon the length of the top from fore to aft, one or more additional pole members are needed and disposed between the front and rear poles to firmly support the intermediate section of the top. Although these pole systems may be pivotally mounted to the boat deck so that they can be folded down and lowered out of the way when the bimini top is not needed, the pole members still obstruct a person on board from reaching out over the side of the boat when fishing, docking or mooring the boat and further present an obstacle in boarding and loading equipment onto the deck. While these and other similarly devised implementations of convertible bimini tops have been effective in providing suitable shade protection from the sun when needed, they have not satisfactorily resolved the problems of obstructions and obstacles caused in and around the boat deck by their supporting framework nor have they provided a completely hands free system of operation both in extended deployment and retracted storage of the bimini top.

SUMMARY OF THE INVENTION

Accordingly, it is a general purpose and object of the present invention to provide an improved retractable bimini top for recreational boats that is fully automated and capable of operative attachment to existing overhead structure on the boat without causing obstructions upon the deck.

A more particular object of the present invention is to provide an improved automated retractable bimini top that may be easily implemented and installed for operational use upon a recreational boat without any additional supporting structure mounted on or around the boat deck.

Another object of the present invention is to provide an automated retractable bimini top for recreational boats that is capable of providing effective sunshade protection to persons on board the boat without presenting obstructions to their movement or performance of tasks on or around the deck.

Still another object of the present invention is to provide an improved automated retractable bimini top that is particularly suitable for use upon a sport fishing boat to provide fishermen with needed shade protection even while game fishing and without hindering their performance.

A further object of the present invention is to provide an automated retractable bimini top that is capable of hands free operation between an extended deployment and retracted state with protection of the retracted top while in storage.

A still further object of the present invention is to provide an automated retractable bimini top that is relatively inexpensive to manufacture, easy to assemble and install upon existing boat structure, and capable of improving the functionality and appearance of the boat upon which it is installed.

Briefly, these and other objects of the present invention are accomplished by a retractable bimini top device automated in operation and mounted for attachment to an existing rooftop member set over the deck of a boat. The inventive device includes a U-shaped support frame having respective side legs adapted to travel longitudinally through a pair of housing tube members disposed in parallel and mounted beneath the rooftop member. The side legs of the U-shaped frame are coaxially fitted within the housing tube members and made to travel together in unison through the respective tube members, each upon a lead screw that is driven by a reversible motor electrically powered and mounted at the end of each tube. A canvas cover attached along its outer end to the transverse portion of the U-shaped frame is stored in a rolled-up state about a spring-loaded roller mounted transversely between the housing tube members so that the canvas cover may be extended in a substantially horizontal manner and retracted as the side legs of the support frame are moved in alternate linear directions through the housing tube members.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DETAILED DESCRIPTION OF THE INVENTION

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to the appended claims.

Figure 1:
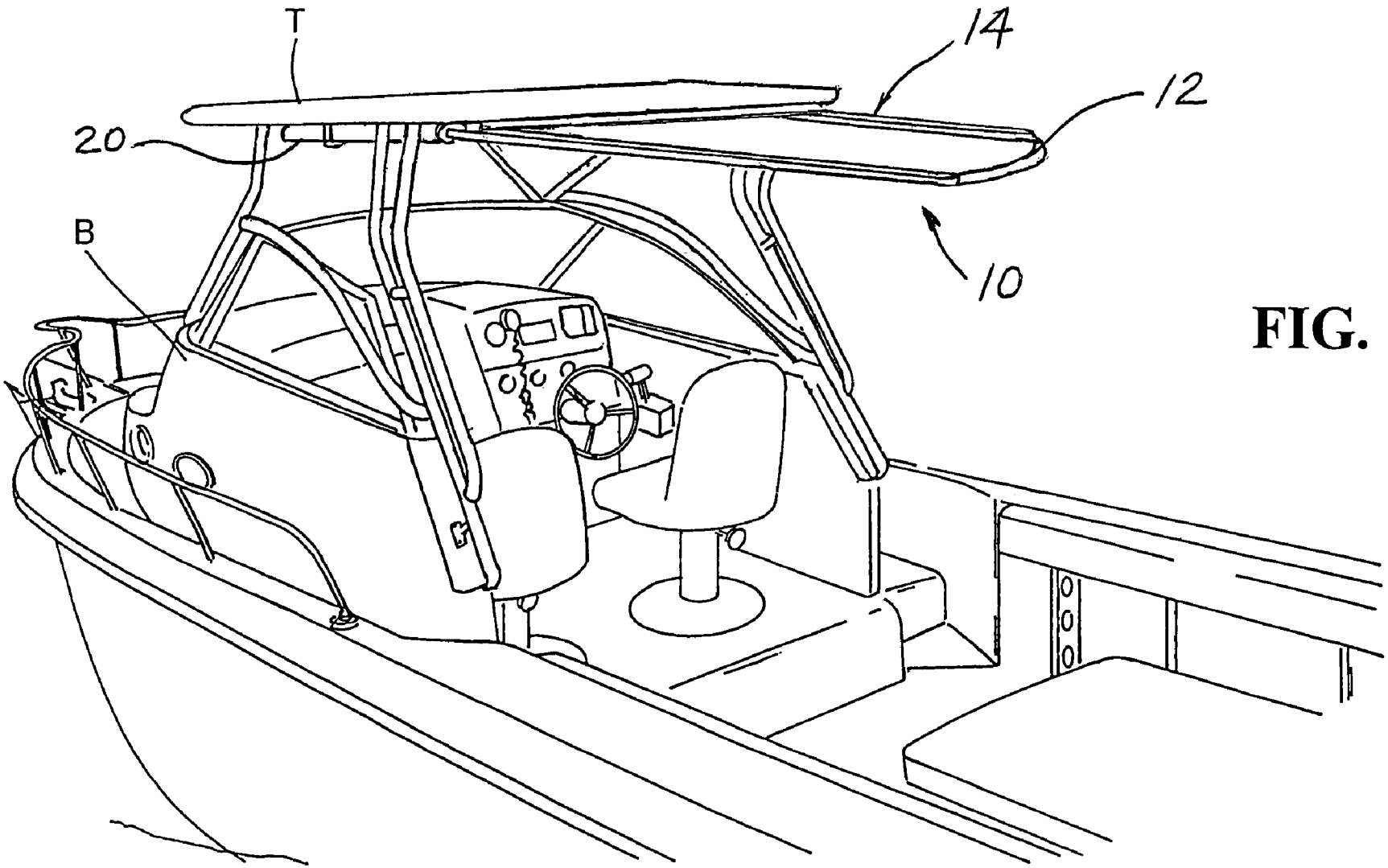
FIG. 1 is a perspective view of a recreational boat equipped with a retractable bimini top device made in accordance with the present invention and shown in extended deployment from rooftop structure on the boat.

Referring now to FIG. 1, a preferred embodiment of the present retractable bimini top device, generally designated 10, is depicted in mounted attachment to and extended deployment from just beneath a rigid canopy or similar rooftop member T set above the deck of a recreational boat B. Designed for automated operation, as described below in greater detail, to provide additional sunshade protection for those on board the boat B, the present retractable bimini top device 10 includes a canvas cover 12 or similar flexible fabric material of an opaque nature that is stored in a rolled-up state and attached at one outer end thereof to a moveable support frame 14 that is disposed for substantially horizontal movement and driven in alternate linear directions through a pair of housing tubes 20 mounted beneath the rooftop member T.

Figure 2:
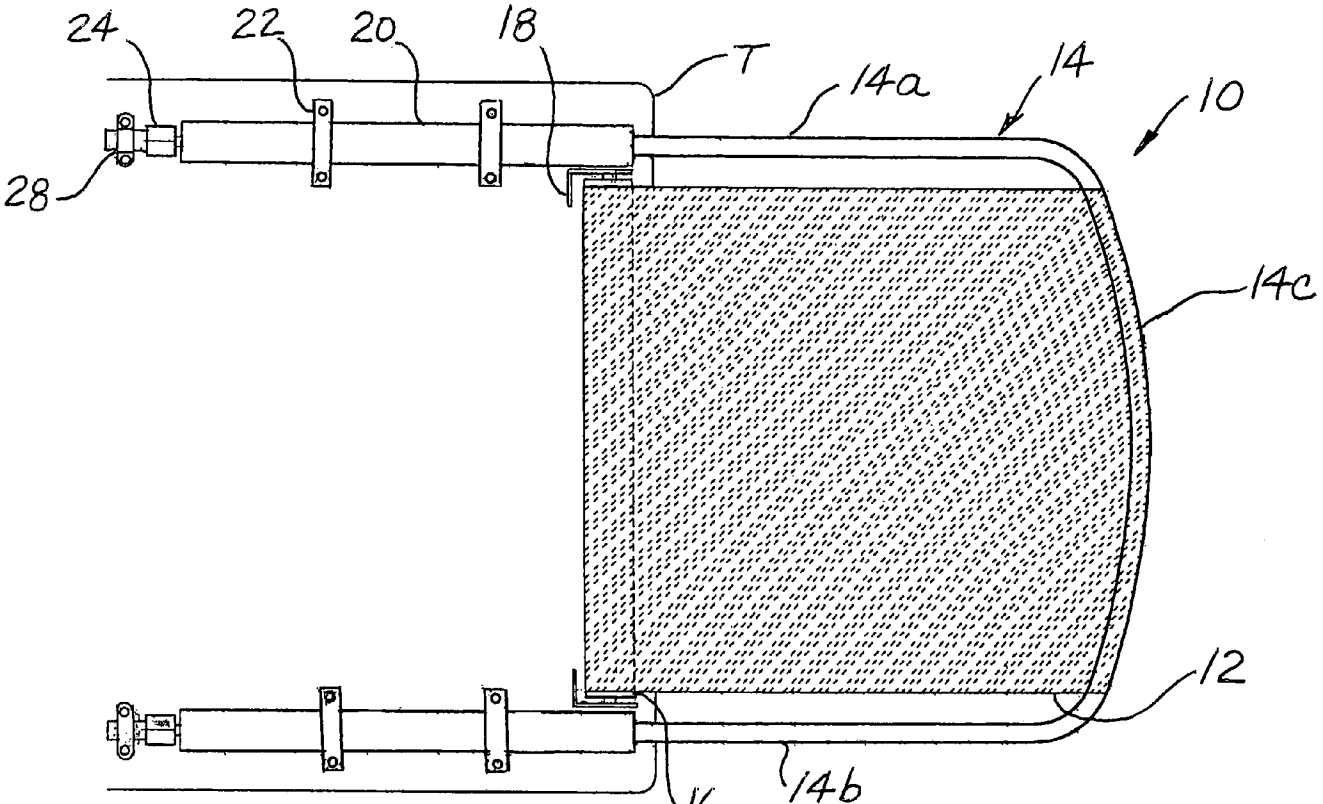
FIG. 2 is a plan view of the retractable bimini top device of FIG. 1 shown in mounted attachment beneath the rooftop structure of the boat.
Figure 3:
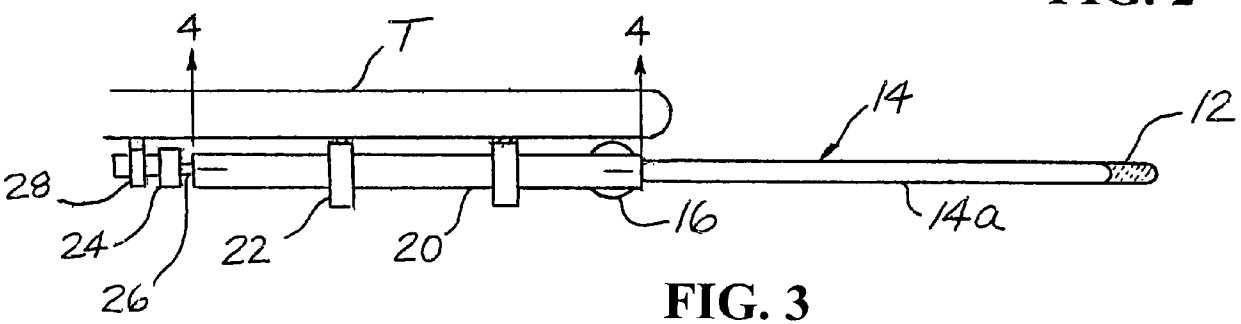
FIG. 3 is a side elevation view of the retractable bimini top device shown in FIG. 2.
Figure 4:
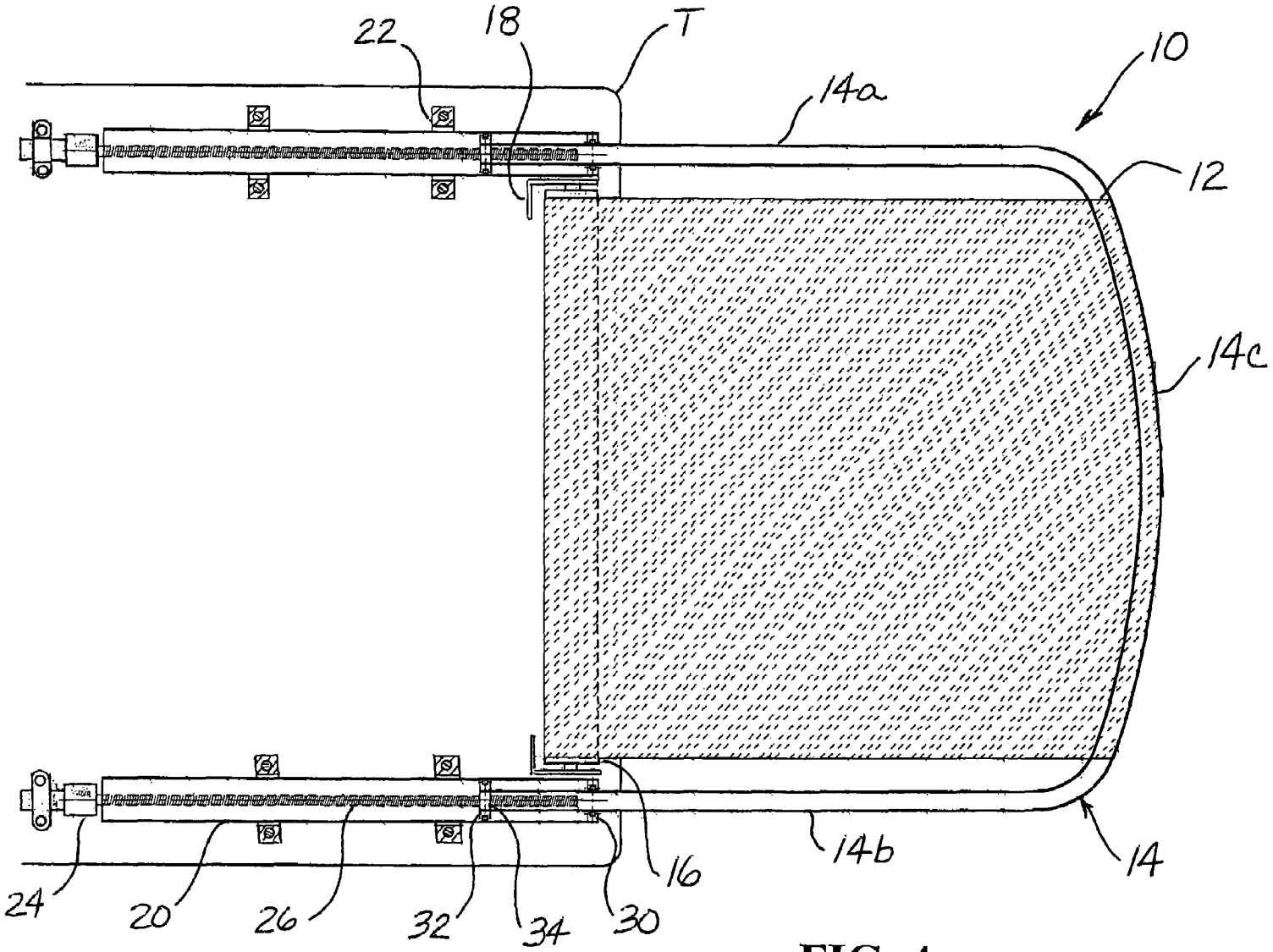
FIG. 4 is an enlarged plan view from below of the retractable bimini top device of FIG. 3 including a partial cross-section taken along the line 4-4 therein.

Referring now to FIGS. 2-4 in conjunction with FIG. 1, the support frame 14 is rigid U-shaped member, preferably tubular in construction, having a pair of substantially parallel legs 14*a* and 14*b* extending longitudinally from a transverse piece 14*c* that is preferably curved in form. The canvas cover 12 is formed and finished in a substantially rectangular configuration, the width thereof being sufficient in size to substantially span the dimension between the legs 14*a* and 14*b* of the support frame. The length of the canvas cover 12 will vary based upon the desired extension of the bimini top device 10. The outer end of the canvas cover 12 is wrapped around the transverse piece 14*c* of the support frame 14 and secured in place, preferably by conventional stitching of the canvas material. The opposite end of the canvas cover 12 is attached along the entire width thereof to the hub interior of a spring-loaded roller 16 of the type commercially available and conventionally used for stored support of retractable awnings. From the interior hub attachment, the canvas cover 12 is wrapped circumferentially in layers around the body of the roller 16 to form the rolled-up state in which the canvas cover is stored in the present bimini top device 10. In its rolled-up state upon spring roller 16, the canvas cover 12 is positioned so as to feed the outer edge of the cover in the direction of the support frame 14 and its attachment to the transverse piece 14*c*, the direction of feed being in opposition to the internal spring force applied and exerted through the spring roller. This internal force is generally established for each spring roller 16 and may be adjusted, typically by turning the roller in place on its end pins. The internal spring force generated by the spring roller 16, adjusted as necessary, assists in the retraction of the canvas cover 12 upon the support frame 14 and further maintains the canvas cover in a relatively taut condition when in extended deployment. A pair of projection brackets 18 of the type conventionally used with standard spring-loaded rollers are positioned to engage opposite ends of spring roller 16 and are attached to the bottom surface of the rooftop member T using conventional hardware to position the roller transversely between the legs 14*a* and 14*b* of the support frame 14 and allow the roller to rotate freely in both directions so that the canvas cover 12 may unroll and retract in a straight path aligned between the opposite legs of the support frame.

The housing tubes 20 used to convey the support frame 14 are cylindrical in form and made in lengths sufficient to contain longitudinally therein substantially all of the respective lengths of the legs 14*a* and 14*b* of the support frame. The housing tubes 20 are spaced apart and disposed in parallel, their separation being established by the transverse dimension between the legs 14*a* and 14*b* of the support frame 14. Positioned in parallel upon the bottom surface of the rooftop T with the spring roller 16 mounted transversely therebetween, the housing tubes 20 are each mounted to the rooftop member via mounting blocks or clamps 22, preferably in pairs along the respective tube lengths, as seen in FIG. 3. Attached to the bottom surface of the rooftop member T using conventional hardware, the mounting blocks 22 are each formed with an aperture therethrough that is made to fit over and engage the outside surface of the housing tubes 20 and together secure the housing tubes in place just beneath the rooftop surface.

A separate pair of reversible electronic motors 24 is used in this preferred embodiment of the present retractable bimini top device 10 to drive the support frame 14 in alternate linear directions through the housing tubes 20 and carrying the attached canvas cover 12. Mounted at the end of each housing tube 20 opposite of the support frame 14, the reversible motors 24 are conventional electronic devices commercially available in a variety of forms and sizes designed to produce a steady level of torque along a drive shaft at predetermined rates of rotation and in opposite directions. In the present embodiment, the drive shaft of each reversible motor 24 is adapted and formed as a lead screw 26, best seen in FIG. 4, having an extended threaded length coaxially disposed through the respective housing tube 20. Each reversible motor 24 is fixed in position at the end of the respective housing tube 20 and mounted to the bottom surface of the rooftop T using a mounting bracket 28 or like form of clamp that holds the body of the motor firmly in place and attaches to the rooftop surface with conventional hardware. The reversible motors 24 are electrically powered and preferably connected to the available power supply on board the boat B with the proper operating voltage being provided using conventional inverters and/or regulators as necessary. Synchronized control of the operation of the reversible motors 24 in both directions is provided by conventional electrical switching, preferably activated by remote-control means, with limit-switching capabilities to limit the revolutions of the lead screw 26 and the corresponding movements of the support frame 14 in both directions.

As best viewed in FIG. 4, the separate legs 14*a* and 14*b* of the support frame 14 each slidingly engage the outer end of the respective housing tube 20 through a bearing fitting 30 affixed to the outer end of each tube. Each end fitting 30 is a ring-like member having a smooth outer surface sized to conform with the inner diameter of the housing tube 20 and an inner bearing surface established by a circular set of ball bearing members, the effective inner diameter of which conforms with the outer surface diameter of the support frame legs 14*a* and 14*b*. Inside each housing tube 20, a moveable bearing fitting 32 is coaxially disposed and further joined and connected to the end of each respective support frame legs 14*a* and 14*b*. Each interior bearing fitting 32 is similarly, like end fittings 30, a ring-like member, but unlike the end fittings, the interior bearing fittings have an outer bearing surface established by a circular set of ball bearing members with the effective outer diameter conforming with the inner surface diameter of the housing tubes 20. The inner surface of each interior bearing fitting 32 is threaded to conform with and engage the threaded surface of each lead screw 26. The inner threading of the interior bearing fittings 32 may be formed integrally upon the surface of the fitting or more preferably, be provided by a threaded insert or nut 34 coaxially fixed therein. As a result of this combination of bearing fittings 30 and 32 and their respective engagements with housing tubes 20 and support frame legs 14*a* and 14*b*, rotational movements of the lead screws 26, concurrently produced under the drive of their respective motor 24, will move the support frame 14 outbound into extended position, as shown particularly in FIG. 4, with the canvas cover 12 fully deployed thereon.

Figure 5:
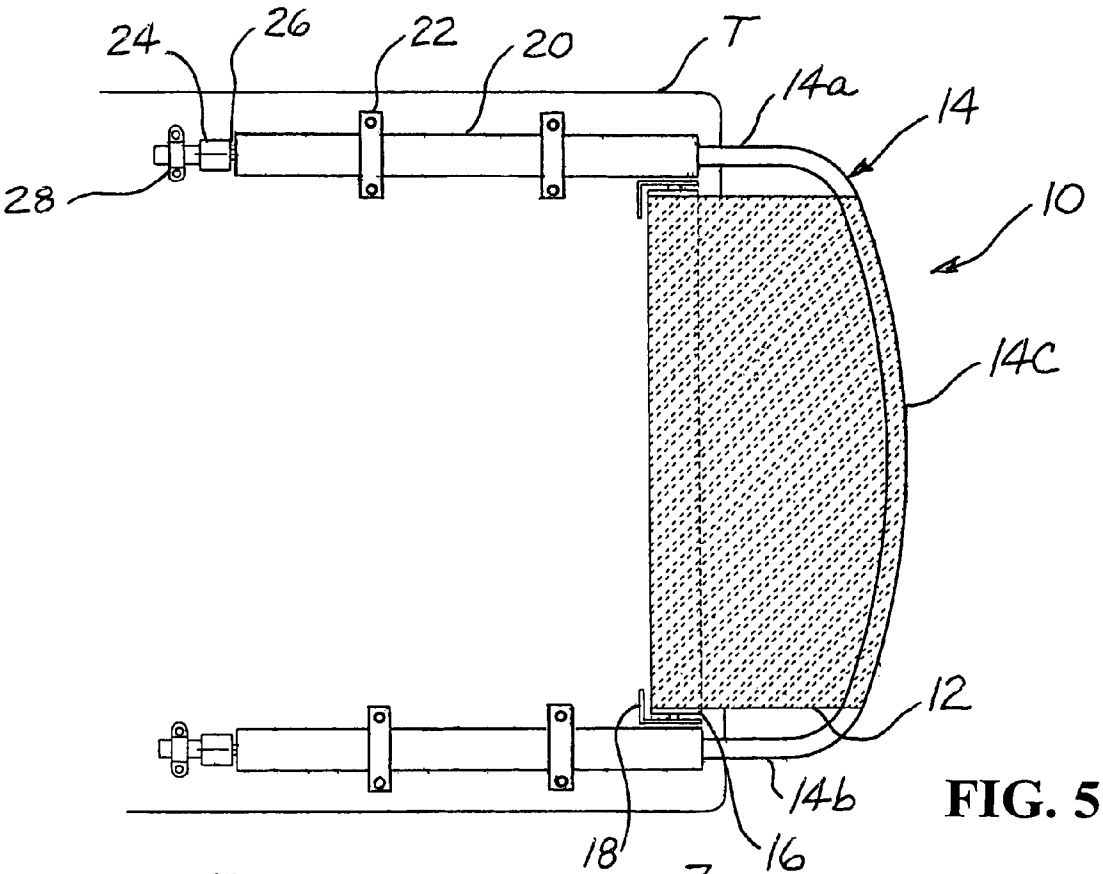
FIG. 5 is a plan view of the retractable bimini top device according to the present invention shown in its retracted position mounted beneath the rooftop structure of the boat.
Figure 6:
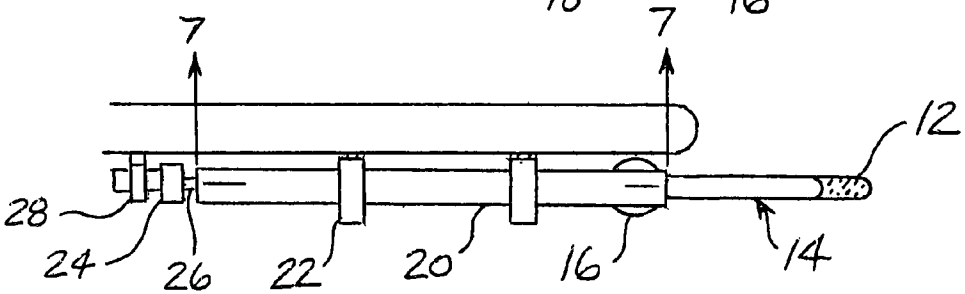
FIG. 6 is a side elevation view of the present retractable bimini top shown in FIG. 5.
Figure 7:
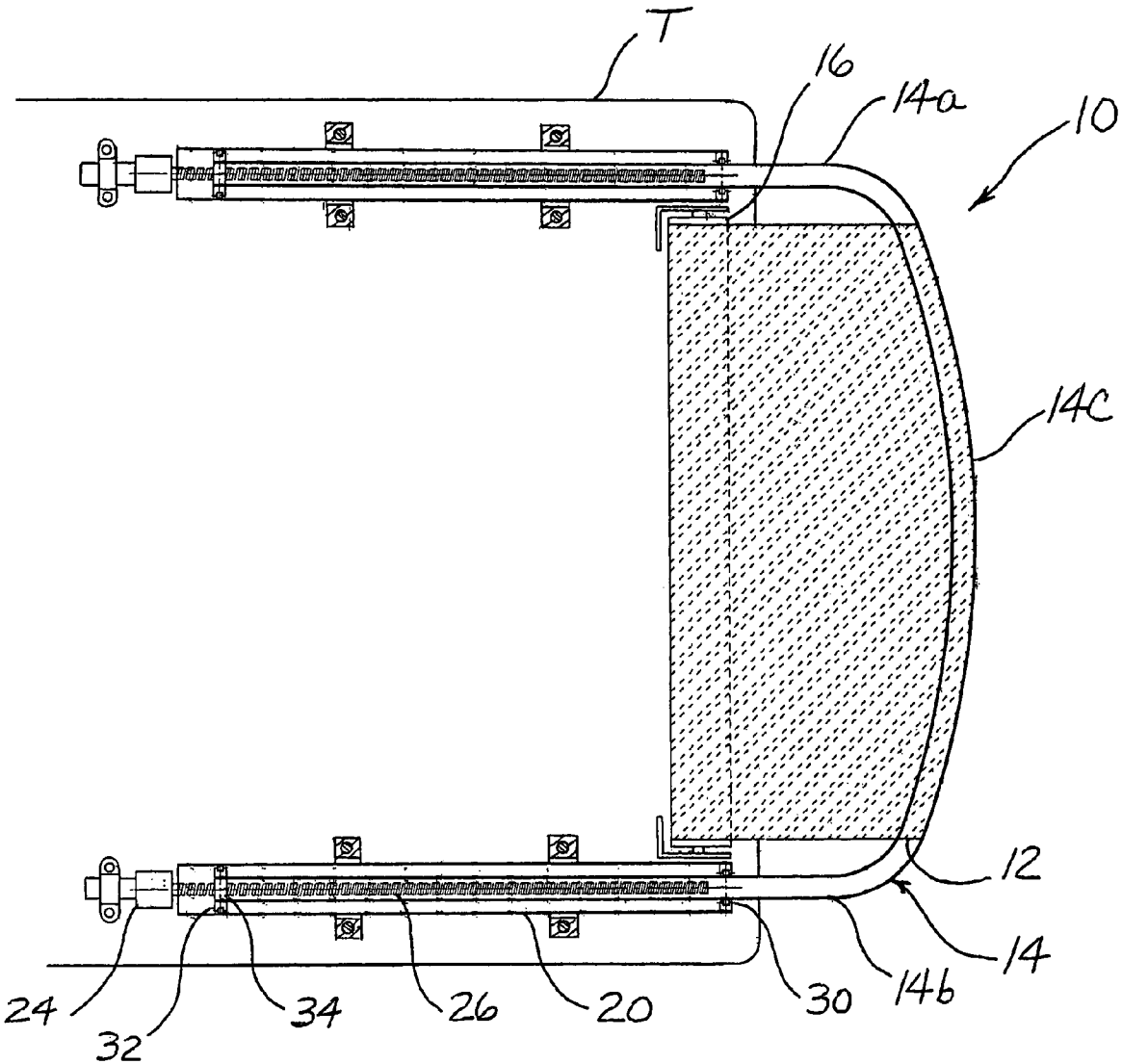
FIG. 7 is an enlarged plan view from below of the retractable bimini top device of FIG. 6 including a partial cross-section taken along the line 7-7 therein.

Referring now to FIGS. 5-7 wherein the present bimini top device 10 is shown in its retracted position, the legs 14*a* and 14*b* of support frame 12 are retracted and drawn together into and substantially through the complete length of each housing tube 20. The support frame legs 14*a* and 14*b* are drawn in unison into such retracted position driven upon the reverse revolutions of lead screws 26 generated by each associated motor 24, the lead screws acting directly through its threaded engagement with the movable inner bearing fitting 32 and its threaded insert 34. While the support frame legs 14*a* and 14*b* are drawn into this retracted position, the movement of the support frame 14 and each of its respective legs is guided and facilitated by the sliding engagement of the support frame legs with the bearing fittings 30 at respective outer ends of the housing tube 20. At the same time the support frame 12 is drawn into the housing tube 20, the extended section of the canvas cover 12 attached to transverse piece 14*c* is drawn onto the spring roller 16 under the influence of its internal spring-loaded force so that upon full retraction of the support frame 14, the transverse piece 14*c* of the support frame is disposed in a position proximate to the edge of the rooftop member T with substantially all of the canvas cover 12 rolled-up onto and stored upon the spring roller 16 just beneath the rooftop member.

Figure 8:
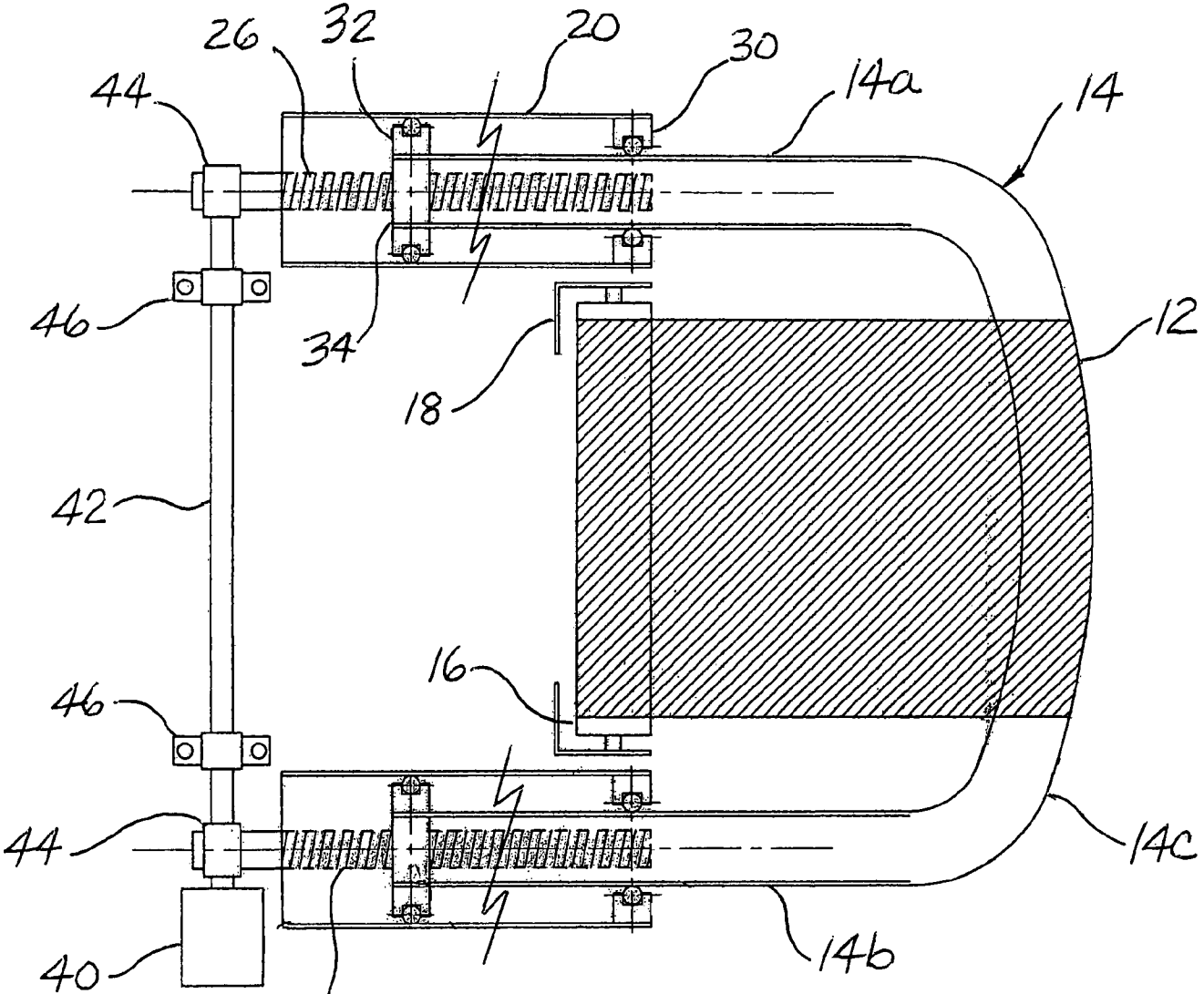
FIG. 8 is a schematic plan view sectioned in part of an alternate embodiment of the retractable bimini top device according to the present invention.

Referring now to FIGS. 8-11, several alternate embodiments of the present retractable bimini top device 10 are illustrated and described here, particularly as to variations in the automated manner used to drive the reversible movement of support frame 14. It is noted with respect to these alternate embodiments that for the most part, the fitted arrangement of the support frame 14 and housing tube 20 together with the attachment and spring-loaded coupling of the canvas cover 12 are substantially the same as described in the preferred embodiment described above. In the embodiment of FIG. 8, one most similar to that described above with respect to FIGS. 1-7, a single reversible motor 40, like that of motors 24, is employed with an associated drive shaft 42 mounted upon the bottom surface of the rooftop member T transversely to the housing tubes 20 using a pair of mounting brackets 46. A pair of worm gears 44 or like rotational converters are coupled to the drive shaft 42 at positions proximate to the ends of the housing tubes 20 and in turn, coupled to a respective lead screw 26 coaxially directed into the housing tube.

Figure 9:
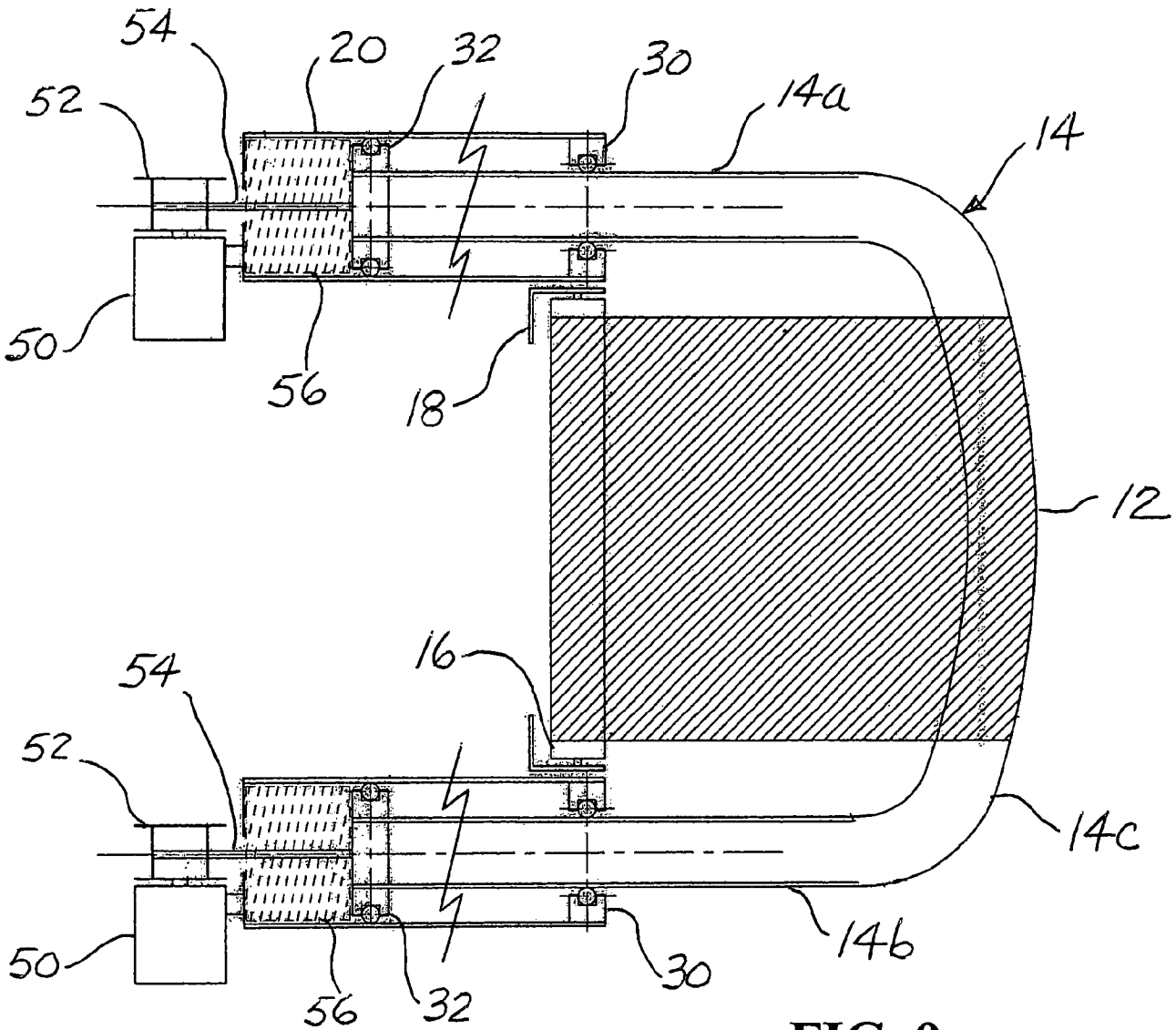
FIG. 9 is a schematic plan view sectioned in part of another alternate embodiment of the present retractable bimini top device.
Figure 10:
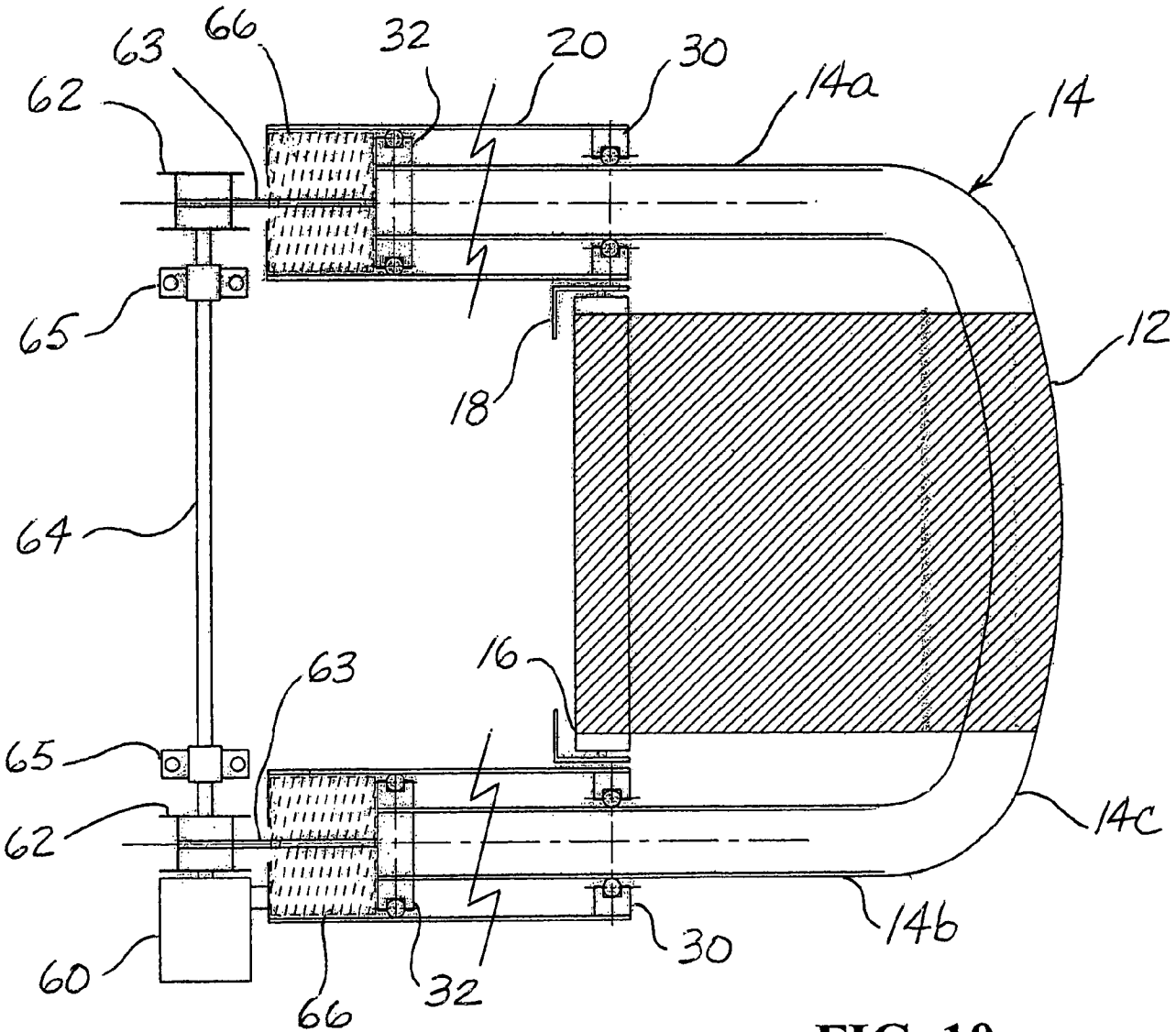
FIG. 10 is a schematic plan view sectioned in part of a further alternate embodiment of the retractable bimini top device according to the present invention.

In both FIGS. 9 and 10, a compression spring 56, typically in a helical coil form, is sized to fit and mounted within each of the respective housing tubes 20 at the inner end thereof opposite to the outer end where the bearing fitting 30 engages the support frame 14. In this mounted position within housing tube 20, each compression spring 56 is made to urge upon inner bearing fittings 32 and the respective support frame legs 14*a* and 14*b* attached thereto thereby providing an outward biasing force upon the support frame 14 in the direction of its extended position. In FIG. 9, opposed drawing forces upon the respective support frame legs 14*a* and 14*b* are equally applied by a pair of unidirectional motors 50 each mounted in proximity to the inner end of a respective housing tube 20 together with an associated pulley member 52 that is coupled to the drive shaft of the motor by means of a conventional clutch. A length of cable 54 is attached at one of its ends to the inner bearing fitting 32 and routed through the compression spring 56 to the pulley member 52 upon which the remaining cable is wound and connected. Under the outward bias forces exerted by the compression spring 56 upon the support frame legs 14*a* and 14, the support frame 14 with the canvas cover 12 attached thereto is pushed forward and outward of the housing tubes 20 to a fully extended position, the clutch coupling of the pulley 52 allowing the length of cable 54 to fully extend. To retract the support frame 14 in this case, the motors 50 are activated and under synchronized control made to pull the length of cable 54 back onto the pulley member 52 and thereby draw the respective support frame legs 14*a* and 14*b* back into the respective housing tubes 20, this while the canvas cover 12 is drawn back onto spring roller 16. In FIG. 10, a similar implementation of an outbound spring force applied to the respective support frame legs 14*a* and 14*b* is accomplished by a pair of compression springs 66 mounted with housing tubes 20 and a drawing force opposed to the spring force is applied using a cable 63 wound upon a pair of motor-driven pulleys 62. In the embodiment of FIG. 10, however, a single unidirectional motor 60 is employed with an extended drive shaft 65 mounted and connected between the separate pulleys.

Figure 11:
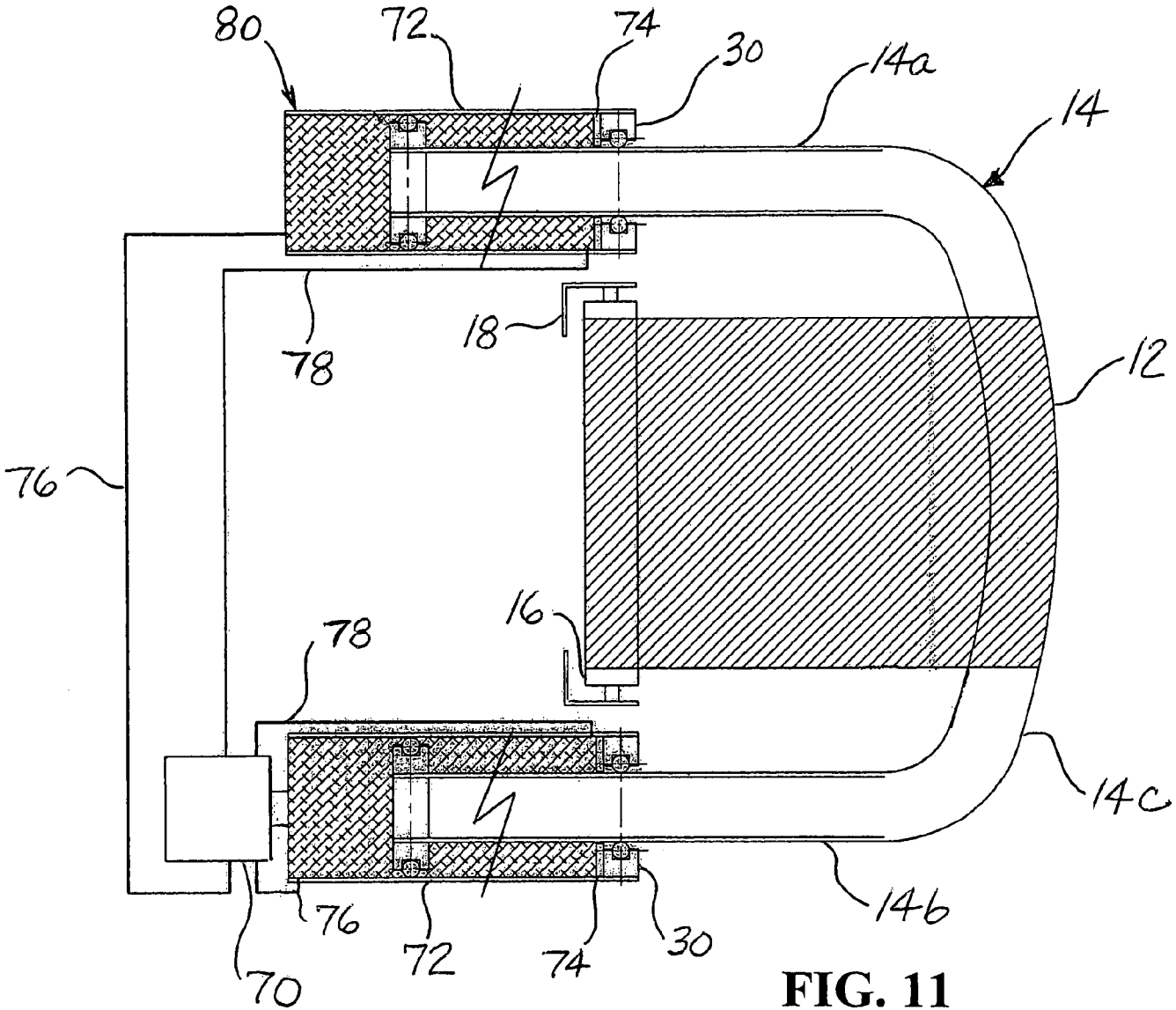
FIG. 11 is a schematic plan view sectioned in part of a still further alternate embodiment of the present retractable bimini top device

In the embodiment of FIG. 11, a hydraulic version of the automated drive means for reversible movement of the support frame 14 is disclosed. A conventional hydraulic motor pump 70 mounted to the roof-top member T generates fluid under pressure and is controlled to feed the fluid through either a pair of rear fluid lines 76 connected to the back end of the respective housing tubes 80 or a pair of forward fluid lines 78 connected to the front end of the housing tubes. The housing tubes 80 in this case are modified versions of the aforedescribed housing tubes 20 in order to both accept the fluid lines 76 and 78 and to provide adequate sealing of the housing chamber. In this latter regard, the back end of housing tube 80 is closed and additional seals 72 and 74 are provided in connection with bearing fittings 30 and 32. To extend the support frame 14 in this case, controlled fluid pressure is fed from the motor pump 70 to the back ends of the respective housing tubes 80 via fluid lines 76 thereby pushing the respective support frame legs 14*a* and 14*b* forward and outward from the housing tubes. To reverse this movement and retract the support frame 14, rear fluid is released from the back of the chamber of the housing tube 80 and forward fluid fed to the front of the chamber via lines 78.

Therefore, it is apparent that the described invention provides an improved retractable bimini top for recreational boats that is fully automated and capable of operative attachment to existing overhead structure on the boat without causing obstructions upon the deck. More particularly, the disclosed inventive device provides an automated retractable bimini top that may be easily implemented and installed for operational use upon a recreational boat without any additional supporting structure mounted on or around the boat deck. In its disclosed operative attachment, the present automated retractable bimini top device is capable of providing effective sunshade protection to persons on board a recreational boat without presenting obstacles to their movement or obstructions to their performance of tasks on or around the deck. The disclosed invention is particularly suitable for use upon a sport fishing boat to provide fishermen with needed shade protection even while game fishing and without hindering their performance. In addition, the present inventive device is capable of hands free operation between an extended deployment and retracted state with protection of the retracted top while in storage. Furthermore, the disclosed device is relatively inexpensive to manufacture, easy to assemble and install upon existing boat structure, and capable of improving the functionality and appearance of the boat upon which it is installed.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. For example, the support frame 14 and its associated mounting attachment may be curved or arched rather than planar, as shown and described, in order to adapt to and fit upon a similarly curved or arched structural member elevated on the boat deck, such as a radar arch. Accordingly, it is understood that this invention is not limited to the particular embodiment described, but rather is intended to cover modifications within the spirit and scope of the present invention as expressed in the appended claims.

What is claimed is:

1. A retractable bimini top device intended for use in mounted attachment to a rooftop member on a boat, comprising:

a length of a cover having respective opposite ends and made of flexible material capable of shading sunlight;

a support frame for said cover mounted in substantial proximity to the rooftop member and moveable in opposite linear directions of travel substantially parallel thereto, said support frame being connected to one end of the length of said cover;

a spring roller for said cover rotatably mounted upon the rooftop member and disposed having the rotational axis thereof substantially transverse to the linear directions of travel of said support frame, said spring roller being connected to the opposite end of the length of said cover;

drive means operatively mounted upon the rooftop member for automatically moving said support frame in opposite linear directions of travel relative to the rooftop member so that said cover may be alternately extended and retracted upon said support frame in cooperation with said spring roller, said drive means comprising reversible motor means operatively connected to said support frame to drive movement of said support frame in the opposite linear directions of travel, said reversible motor means comprising a reversible motor having an extended drive shaft threaded along the length thereof; and housing means operatively connected to said reversible motor means for guiding movement of said support frame in the opposite linear directions of travel, said housing means comprising a housing tube member formed to contain movement of said support frame; a first bearing member fitted and fixed to one end of said housing tube member to provide sliding engagement of said support frame with said housing tube member; and a second bearing member slidingly disposed within said housing tube member and formed for threaded engagement with the drive shaft of said reversible motor for moving said support frame in the opposite linear directions of travel through said housing tube member.

2. A retractable bimini top device according to claim 1, wherein said support frame is a U-shaped member having a pair of substantially parallel legs extending longitudinally from a transverse section.

3. A retractable bimini top device according to claim 2, wherein said cover is a canvas material attached at one end of its length to the transverse section of said support frame.

4. A retractable sunshade device for automated deployment on a boat, comprising:

a cover having respective opposite ends and made of flexible material capable of shading sunlight;

a support frame for said cover connected to one end thereof and mounted on the boat for substantially horizontal movement thereon in opposite linear directions of travel;

a spring roller for said cover rotatably mounted and disposed having the rotational axis thereof substantially transverse to the linear directions of movement of said support frame, said spring roller being connected to the opposite end of said cover;

drive means operatively connected to said support frame for automatically moving said support frame in the opposite linear directions of travel so that said cover may be alternately extended and retracted upon said support frame in cooperation with said spring roller, said drive means comprising a reversible motor having an extended drive shaft operatively connected to said support frame to drive the movement of said support frame in the opposite linear directions of travel; and housing means operatively connected to said reversible motor for guiding movement of said support frame in the opposite linear directions of travel, said housing means comprising a housing tube member formed to contain the movement of said support frame; a first bearing member fitted and fixed to one end of said housing tube member to provide sliding engagement of said support frame with said housing tube member; and a second bearing member slidingly disposed within said housing tube member and formed for threaded engagement with the drive shaft of said reversible motor for moving said support frame in the opposite linear directions of travel through said housing tube member.

5. A retractable sunshade device according to claim 4, wherein said support frame is a U-shaped member having a pair of substantially parallel legs extending longitudinally from a transverse section.

6. A retractable sunshade device according to claim 5, wherein said cover is a canvas material attached at one end of its length to the transverse section of said support frame.

7. On a recreational boat having a rigid tower structure set above the boat deck, the improvement for providing automated sunshade protection comprising:

a length of a cover having respective opposite ends and made of flexible material capable of shading sunlight;

a support frame for said cover coupled to the tower structure and moveable relative thereto above the boat deck in opposite linear directions of travel, said support frame being connected to one end of the length of said cover;

a spring roller for said cover rotatably mounted upon the tower structure and disposed having the rotational axis thereof substantially transverse to the opposite linear directions of travel of said support frame, said spring roller being connected to the opposite end of the length of said cover;

drive means operatively mounted upon the rigid tower for automatically moving said support frame in the opposite linear directions of travel relative to the rigid tower so that said cover may be alternately extended and retracted upon said support frame in cooperation with said spring roller, said drive means comprising reversible motor means operatively connected to said support frame to drive movement of said support frame in the opposite linear directions of travel, said reversible motor means including a reversible motor having an extended drive shaft threaded along the length thereof; and housing means operatively connected to said reversible motor means for guiding movement of said support frame in the opposite linear directions of travel, said housing means comprising a housing tube member formed to contain the movement of said support frame; a first bearing member fitted and fixed to one end of said housing tube member to provide sliding engagement of said support frame with said housing tube member; and a second bearing member slidingly disposed within said housing tube member and formed for threaded engagement with the drive shaft of said reversible motor for moving said support frame in the opposite linear directions of travel through said housing tube member.

* * * * *